US010816173B2

(12) United States Patent
Vlad et al.

(10) Patent No.: US 10,816,173 B2
(45) Date of Patent: Oct. 27, 2020

(54) MOUNTING BRACKETS

(71) Applicant: Luminii, Niles, IL (US)

(72) Inventors: Laurentiu O. Vlad, Northfield, IL (US); Christopher J. Ferguson, Bend, OR (US)

(73) Assignee: Luminii, Niles, IL (US)

( * ) Notice: Subject to any disclaimer, the term of this patent is extended or adjusted under 35 U.S.C. 154(b) by 0 days.

(21) Appl. No.: 16/237,380

(22) Filed: Dec. 31, 2018

(65) Prior Publication Data

US 2020/0208812 A1 Jul. 2, 2020

(51) Int. Cl.

| | |
|---|---|
| ***F21V 21/04*** | (2006.01) |
| ***F21S 8/02*** | (2006.01) |
| *F21Y 115/10* | (2016.01) |

(52) U.S. Cl.

CPC ..... *F21V 21/049* (2013.01); *F21S 8/024* (2013.01); *F21S 8/026* (2013.01); *F21Y 2115/10* (2016.08)

(58) Field of Classification Search

None

See application file for complete search history.

(56) References Cited

U.S. PATENT DOCUMENTS

| | | | | |
|---|---|---|---|---|
| 3,834,106 | A | 9/1974 | Astedt et al. | |
| 4,118,760 | A * | 10/1978 | Cohon | F21S 8/033 362/239 |
| 4,408,428 | A | 10/1983 | Brooke et al. | |
| D318,177 | S | 7/1991 | Winter | |
| D325,641 | S | 4/1992 | Dallaire et al. | |
| 5,335,890 | A | 8/1994 | Pryor et al. | |
| 5,758,959 | A | 6/1998 | Sieczkowski | |
| 6,364,511 | B1 | 4/2002 | Cohen | |
| D513,171 | S | 12/2005 | Richardson | |
| 6,971,210 | B2 | 12/2005 | Kliegle et al. | |
| D551,384 | S | 9/2007 | Rashidi | |

(Continued)

FOREIGN PATENT DOCUMENTS

| | | | |
|---|---|---|---|
| CN | 107268867 | A | 10/2017 |
| CN | 207179574 | U | 4/2018 |

(Continued)

OTHER PUBLICATIONS

Deep Recess Line LED Strip Mounting Profile—Lighting Matters, retrieved at http://lightingmatters.com.au/wp/shop/deep-recess-line-led-strip-mounting-profile on Dec. 31, 2018.

(Continued)

*Primary Examiner* — Ashok Patel

(74) *Attorney, Agent, or Firm* — Venable LLP; Michele V. Frank

(57) ABSTRACT

Mounting brackets for installing extruded profiles on surfaces, such as walls, ceilings, tile surfaces, etc., may be resilient. The mounting bracket may include a coil spring designed to rotate or pivot with respect to a main body. The spring may apply force to a rear of the surface thus holding or maintaining the mounting bracket in place. The mounting bracket may be a flat spring. The flat spring may apply force to side surfaces of an opening formed in the surface thus holding or maintaining the mounting bracket in place. The mounting bracket may hold an elongated profile designed for recessed LED lighting to the surface.

13 Claims, 12 Drawing Sheets

(56) References Cited

U.S. PATENT DOCUMENTS

| | | | |
|---|---|---|---|
| D551,797 | S | 9/2007 | Rashidi |
| D557,112 | S | 12/2007 | Franssen |
| D562,490 | S | 2/2008 | Rashidi |
| D576,023 | S | 9/2008 | Urmson, Jr. et al. |
| D601,000 | S | 9/2009 | Cole et al. |
| D601,293 | S | 9/2009 | MacKenzie |
| D615,387 | S | 5/2010 | Prichard |
| D615,848 | S | 5/2010 | Prichard et al. |
| D640,819 | S | 6/2011 | Pan |
| D667,155 | S | 9/2012 | Rashidi |
| 8,348,477 | B2 | 1/2013 | Tickner et al. |
| D678,583 | S | 3/2013 | Jeswani et al. |
| D679,044 | S | 3/2013 | Jeswani et al. |
| D683,882 | S | 6/2013 | Rashidi |
| D684,289 | S | 6/2013 | Goelz et al. |
| D684,291 | S | 6/2013 | Goelz et al. |
| D684,720 | S | 6/2013 | Rashidi |
| D685,120 | S | 6/2013 | Rashidi |
| D685,121 | S | 6/2013 | Rashidi |
| D690,865 | S | 10/2013 | Rashidi |
| D690,866 | S | 10/2013 | Rashidi |
| D691,316 | S | 10/2013 | Rashidi |
| D691,317 | S | 10/2013 | Rashidi |
| D692,172 | S | 10/2013 | Rashidi |
| D692,173 | S | 10/2013 | Rashidi |
| D692,175 | S | 10/2013 | Rashidi |
| D698,068 | S | 1/2014 | Rashidi |
| 8,683,768 | B2 | 4/2014 | Gerkes et al. |
| D708,381 | S | 7/2014 | Rashidi |
| D724,257 | S | 3/2015 | Klus |
| D724,260 | S | 3/2015 | Klus |
| D724,261 | S | 3/2015 | Klus |
| 9,010,956 | B1 | 4/2015 | Davis |
| D731,704 | S | 6/2015 | Klus |
| 9,052,081 | B1 | 6/2015 | Paulsel |
| 9,140,441 | B2 | 9/2015 | Goelz et al. |
| D742,540 | S | 11/2015 | Singh |
| D752,422 | S | 3/2016 | Veilleux et al. |
| 9,291,319 | B2 | 3/2016 | Kathawate et al. |
| 9,341,349 | B1 | 5/2016 | Moore |
| 9,353,933 | B2 | 5/2016 | Van De Ven |
| D775,409 | S | 12/2016 | Klus |
| D775,410 | S | 12/2016 | Klus |
| 9,565,769 | B2 | 2/2017 | Dankelmann et al. |
| D782,104 | S | 3/2017 | Klus |
| D782,105 | S | 3/2017 | Klus |
| D782,106 | S | 3/2017 | Porciatti |
| D792,017 | S | 7/2017 | Klus |
| 9,702,533 | B1 | 7/2017 | Harpenau et al. |
| D796,110 | S | 8/2017 | Klus |
| 9,739,455 | B2 | 8/2017 | Rodriguez et al. |
| D797,977 | S | 9/2017 | Farzan |
| D798,471 | S | 9/2017 | Tremaine et al. |
| D799,065 | S | 10/2017 | Tremaine et al. |
| D807,572 | S | 1/2018 | Klus |
| 9,879,850 | B2 * | 1/2018 | Porciatti ..... F24F 3/056 |
| D809,704 | S | 2/2018 | Klus |
| 9,933,144 | B2 | 4/2018 | Mandy et al. |
| 9,939,136 | B2 | 4/2018 | Vidal |
| D818,188 | S | 5/2018 | Trzesniowski |
| D818,194 | S | 5/2018 | Trzesniowski |
| D818,633 | S | 5/2018 | Barker et al. |
| D821,611 | S | 6/2018 | Singh |
| D821,851 | S | 7/2018 | Stahl et al. |
| D822,455 | S | 7/2018 | Stahl et al. |
| D823,095 | S | 7/2018 | Stahl et al. |
| D824,584 | S | 7/2018 | Klus |
| 10,054,274 | B2 | 8/2018 | Athalye et al. |
| D829,348 | S | 9/2018 | Hynek et al. |
| 2004/0061032 | A1 | 4/2004 | Bradford et al. |
| 2005/0034402 | A1 | 2/2005 | Johnson |
| 2005/0258653 | A1 | 11/2005 | Jacobs |
| 2011/0267827 | A1 | 11/2011 | Wein |
| 2013/0083514 | A1 | 4/2013 | Wong et al. |
| 2015/0330611 | A1 | 11/2015 | Abai et al. |

FOREIGN PATENT DOCUMENTS

| | | | |
|---|---|---|---|
| EP | D499044 | A1 | 8/1992 |
| ES | 248856 | U | 5/1980 |
| WO | 2015181413 | A1 | 12/2015 |

OTHER PUBLICATIONS

LED Profile Recessed Ceiling for LED Strip—Aluminium LED Channel Can Diffuser + End Caps, Retrieved at https://www.theledstore.co/recessed-celing-led-profile-for-led-strip on Oct. 4, 2018.

LED Tape Light Aluminium Mounting Channel, retrieved at https://step1dezigns.com/led-aluminium-mounting-channel-6-feet-stvofich12 on Dec. 31, 2018.

Klus, LLC: Inspiring Solutions; OPAC-30 Extrusion, retrieved at https://klusdesign.com/product/423 on Dec. 19, 2018.

Luminii Corp.; KRS Channel, retrieved at https://www.luminii.com/image/data/Products/Linear-aluminum-extrusions/Products/KRS%20Channel/Upload/KRSC.pdf on Dec. 19, 2018.

Surface Mount LED Profile Housing, retrieved at https://www.superbrightleds.com/moreinfo/housings/klus-b4574-gip-series-surface-mount-anodized-aluminum-led-profile-housing/1421 on Dec. 31, 2018.

Trulux 78.7" Standard Flange Slot Recessed Mount Anodized Aluminum Extrusion, retrieved at https://www.prolighting.com/pe-dfslot-2m.html? utm_source=google_shopping&gclid=EAlalQobChMlraGp1NDq3Q1Vgh5pCh2qLgQLEAQYAyABEgITvfD_BwE on Dec. 31, 2018.

* cited by examiner

MOUNTING BRACKETS

TECHNICAL FIELD OF THE INVENTION

The present inventions relate generally to mounting brackets for mounting an elongated profile to a surface. More specifically, the present inventions relate to mounting brackets for mounting an elongated profile for recess-mounted LED lighting.

BACKGROUND OF THE INVENTION

Recessed lighting may be difficult to install. Recessed lighting may require access to an area or space above a ceiling or behind a wall, making it difficult to install. Additionally, it may be difficult or impossible to install recessed lighting in hard surfaces, such as tile and stones. Current mounting brackets may be not fully support recessed lighting in these situations or may be difficult and cumbersome to install. A need exists for a mounting bracket to easily and sufficiently install recessed lighting in a surface, such as a ceiling, wall, or tile or stone surface.

BRIEF SUMMARY OF THE INVENTION

According to an embodiment, a system for mounting recessed lighting may include an elongated profile, the elongated profile having: a first channel extending along a length of the elongated profile; and a second channel opposing the first channel and extending along the length of the elongated profile; and mounting brackets disposed in the first channel, wherein the mounting brackets are configured to secure the elongated profile to a surface, and wherein the mounting brackets are disposed along the length of the elongated profile.

According to an embodiment, the mounting brackets include springs, the springs configured to apply force to a portion of the surface to secure the elongated profile to the surface.

According to an embodiment, the spring is one of a coil spring or a flat spring.

According to an embodiment, the elongated profile is configured to be installed in an opening in the surface.

According to an embodiment, the opening is a through-hole extending from a front to a rear of the surface and wherein each of the mounting brackets further comprises a base, a flange coupled to the base, and a spring pivotally coupled to the flange.

According to an embodiment, the base is configured to be received in the first channel and wherein the spring comprises a coil portion and an elongated portion and wherein the elongated portion is configured to engage the rear of the surface.

According to an embodiment, the spring is entirely located behind the rear of the surface.

According to an embodiment, the elongated portion of adjacent mounting brackets extend in opposing directions.

According to an embodiment, the opening is a notch or slot extending within the surface and the opening is not a through-hole extending from a front to a rear of the surface and wherein each of the mounting brackets further comprises a base and a plurality of outward extending portions coupled to the base.

According to an embodiment, two opposing outward extending portions are flat springs, and wherein an apex of the flat springs are configured to engage opposing side walls of the opening.

According to an embodiment, the flat springs are entirely located within the opening.

According to an embodiment, the system is for mounting recessed LED lighting.

According to an embodiment, a mounting bracket may include a base configured to engage a profile; a flange coupled to the base; and a spring pivotally coupled to the flange, the spring comprising a coil portion and an elongated portion, wherein the spring is configured to secure the profile to a surface.

According to an embodiment, the coil portion is wrapped around the flange through an opening provided in an end portion of the flange.

According to an embodiment, the coil portion and the elongated portion are formed integrally.

According to an embodiment, the flange extends substantially perpendicularly to the base and wherein the flange and base are fixedly coupled together.

According to an embodiment, a mounting bracket may include a base configured to engage a profile; a first outward extending portion and a second outward extending portion coupled to opposing sides of the base, the first outward extending portion and the second outward extending portion being mirror images; and a third outward extending portion and a fourth outward extending portion coupled to opposing sides of the base, the third outward extending portion and the fourth outward extending portion being mirror images, wherein the first outward extending portion and the second outward extending portion are configured to secure the profile to a surface.

According to an embodiment, each of the first outward extending portion and the second outward extending portion include a first leg extending outward from the base and a second leg extending inward toward the base, wherein an apex is defined where the first leg meets the second leg and the apex is configured to engage an opening in the surface.

According to an embodiment, each of the first outward extending portion and the second outward extending portion are flat springs and are configured to apply force to a side surface of an opening formed in the surface to maintain or hold the mounting bracket in the opening.

According to an embodiment, each of the third outward extending portion and the fourth outward extending portion include a rectangular portion and an elongated portion, wherein the elongated portion is configured to be received in the profile.

BRIEF DESCRIPTION OF DRAWINGS

The accompanying drawings, which are included to provide a further understanding of the invention and are incorporated in and constitute a part of this specification, illustrate preferred embodiments of the invention and together with the detailed description serve to explain the principles of the invention. In the drawings.

DETAILED DESCRIPTION OF THE INVENTIONS

Figure 1:
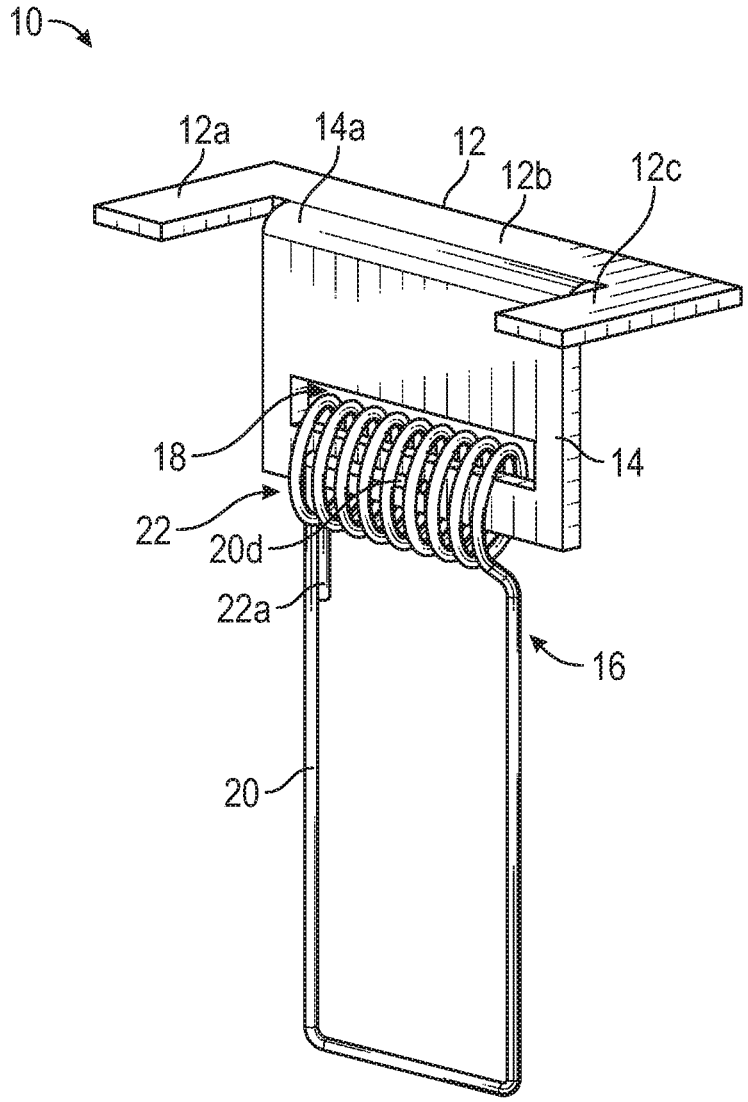
FIG. 1 shows a perspective view of a mounting bracket, according to an embodiment.
Figure 3:
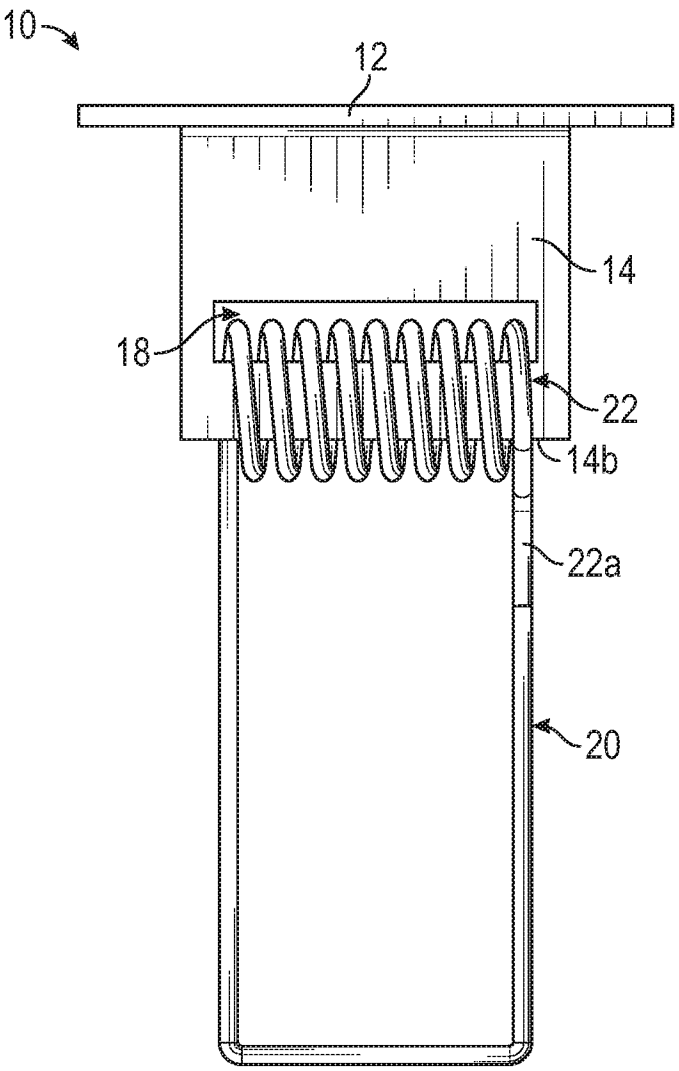
FIG. 3 shows a rear view of the mounting bracket of FIG. 1, according to an embodiment.
Figure 2:
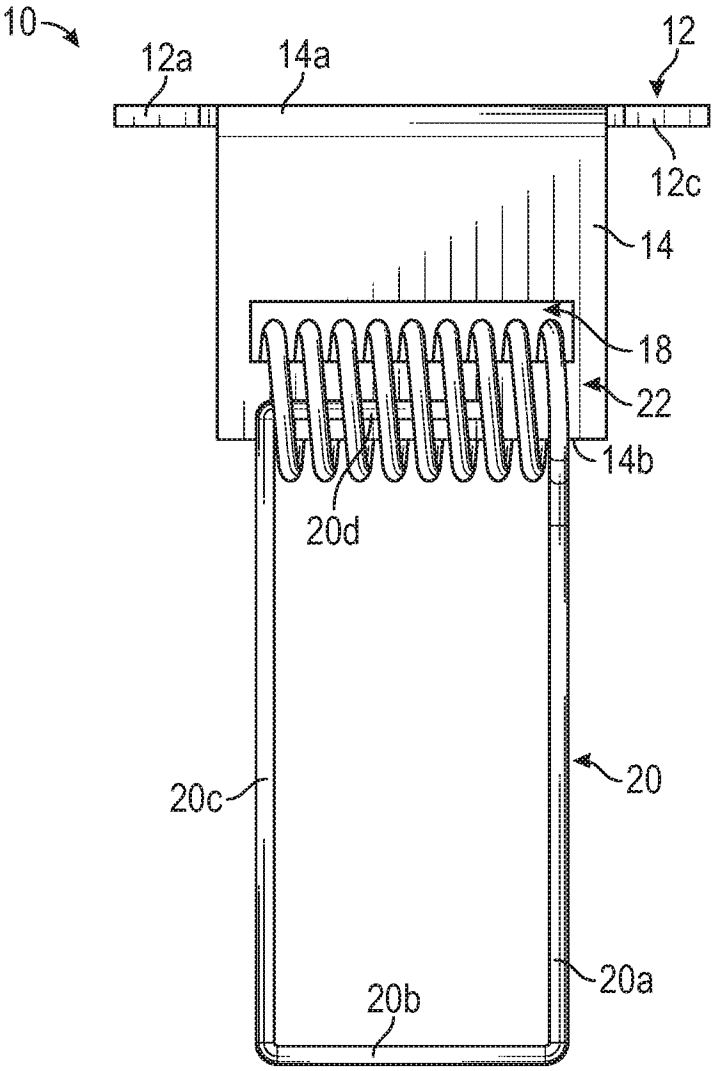
FIG. 2 shows a front view of the mounting bracket of FIG. 1, according to an embodiment.
Figure 4:
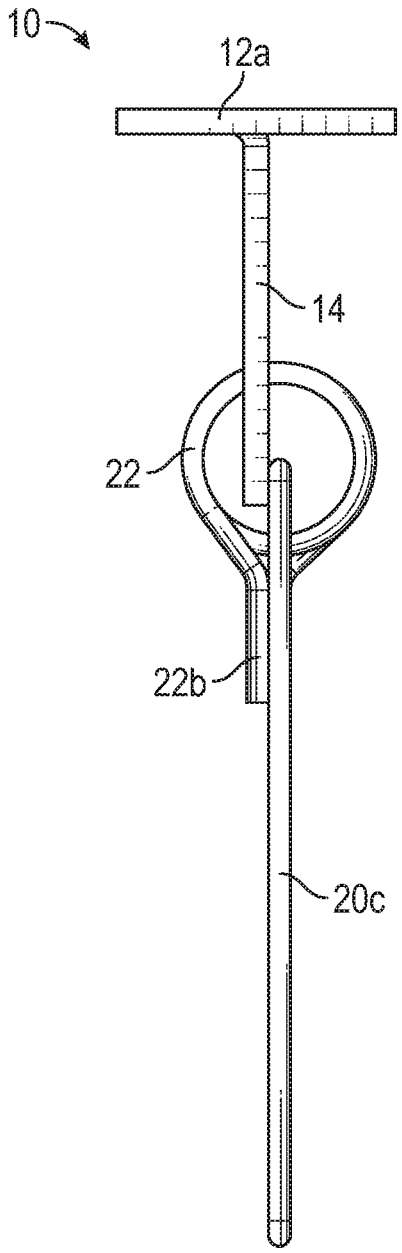
FIG. 4 shows a left view of the mounting bracket of FIG. 1, according to an embodiment.
Figure 5:
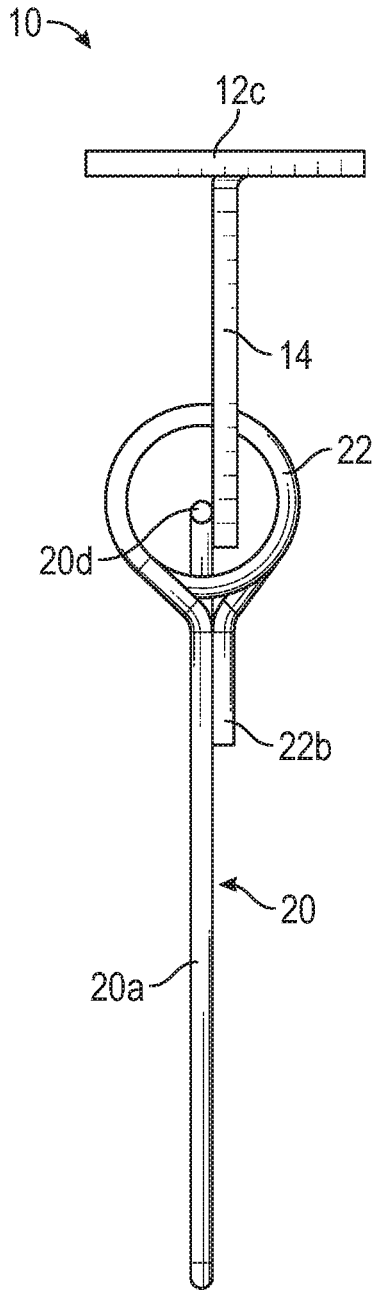
FIG. 5 shows a right view of the mounting bracket of FIG. 1, according to an embodiment.
Figure 6:
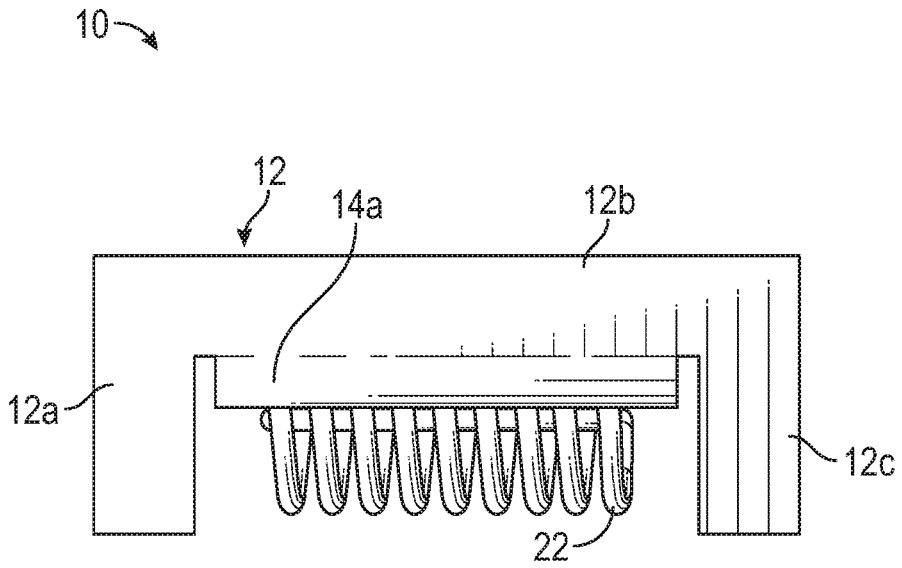
FIG. 6 shows a top view of the mounting bracket of FIG. 1, according to an embodiment.
Figure 7:
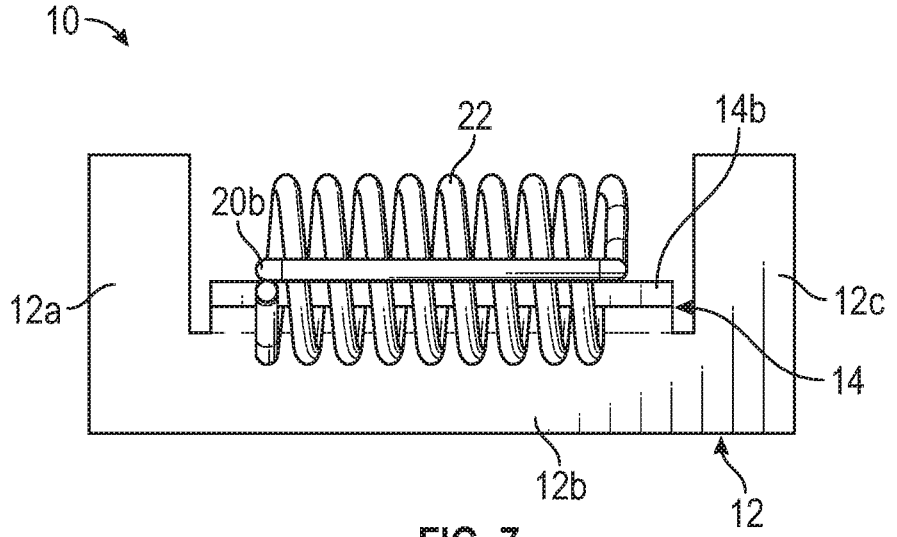
FIG. 7 shows a bottom view of the mounting bracket of FIG. 1, according to an embodiment.

According to embodiments of the invention, mounting brackets for installing on surfaces, such as walls, ceilings, tile surfaces, etc., may be resilient. That is, in one embodiment, the mounting bracket may include a coil spring designed to rotate or pivot with respect to a main body. The spring may apply force to a rear of the surface thus holding or maintaining the mounting bracket in place. In another embodiment, the mounting bracket may be a flat spring. The flat spring may apply force to side surfaces of an opening formed in the surface thus holding or maintaining the mounting bracket in place. In either embodiment, the mounting bracket may hold an elongated profile designed for recessed LED lighting to the surface.

Referring to FIGS. 1-7, a mounting bracket 10 is shown. The mounting bracket 10 may include a base 12, a flange 14, and a spring 16. The base 12 may be a flat plate or plate-like body. The base 12 may be C-shaped or U-shaped, although other shapes are contemplated. The base 12 may have a main body 12*b* with a first extending portion 12*a* and a second extending portion 12*c*. The first extending portion 12*a* and the second extending portion 12*c* may extend the same distance from the main body 12*b*. The first extending portion 12*a* and the second extending portion 12*c* may extend laterally from the base 12. The base 12 may have an overall length and/or an overall width that is larger than the thickness of the base 12.

The flange 14 may extend vertically and/or substantially perpendicularly from the base 12. The flange 14 may be connected or attached to the base 12 with a curved portion 14*a*. The base 12 may be substantially aligned with a horizontal axis and the flange 14 may be aligned with a vertical axis, the horizontal and vertical axes being substantially perpendicular. The flange and curved portion 14*a* may be fixed or secured to the base 12. The flange 14, curved portion 14*a*, and base 12 may be coupled such that no relative movement is permitted. The flange 14, curved portion 14*a*, and base 12 may be integrally formed. The flange 14, curved portion 14*a*, and base 12 may be formed from metal.

A spring 16 may be coupled to the flange 14 through an opening 18. The opening 18 may be an elongated opening located at a distal end (e.g., near the distal end 14*b*) of the flange 14. The opening 18 may be substantially rectangular, although other shapes are contemplated. The spring 16 may be a coil spring. The spring 16 may include an elongated portion 20 and a coil portion 22. The elongated portion 20 may be substantially rectangular. The coil portion 22 may be a series of substantially circular coils. The coils of the coil portion 22 may extend around a portion of the flange 14 between the opening 18 and the distal end 14*b*. The coils of the coil portion 22 may extend through the opening 18. The coil portion 22 may be wrapped loosely through the opening 18 such that the spring 16 is allowed to rotate or move with respect to the flange 14.

With continued reference to FIGS. 1-7, the spring 16 may be formed of an elongated cylindrical member, such as a wire or flexible wire. The body of the spring 16 may have a first end 22*a*. The first end 22*a* may extend vertically from the flange 14 and may be substantially aligned with the vertical axis of the flange 14. From the first end 22*a*, the coil portion 22 may extend around the portion of the flange 14 between the opening 18 and the distal end 14*b* and may extend through the opening 18.

The coil portion 22 may have a side opposing the first end 22*a*, the side may extend into the elongated portion. The side of the coil portion 22 may extend into a first leg 20*a* of the elongated portion 20. The first leg 20*a* may curve into a second leg 20*b* which may curve into a third leg 20*c*. The third leg 20*c* may curve into the second end 20*d*. The second end 20*d* may extend along the portion of the flange 14 between the opening 18 and the distal end 14*b*. The second end 20*d* may be substantially aligned with the long axis of the elongated opening 18. The second end 20*d* and the second leg 20*b* may be substantially parallel. The first leg 20*a* and the third leg 20*c* may be substantially parallel. The second end 20*d* and the second leg 20*b* may be substantially perpendicular to the first leg 20*a* and the third leg 20*c*. The first end 22*a* may be substantially parallel to and adjacent with the third leg 20*c*. The second end 20*d* may be adjacent to the flange 14 and may be located between the opening 18 and the distal end 14*b* of the flange 14.

Referring to FIGS. 8-12, the mounting bracket 10 is shown in conjunction with an elongated profile 50. As will be described in more detail, the elongated profile 50 may include a recess, groove, or channel in which the mounting bracket 10 may be received. The base 12 may be slid, aligned, or otherwise installed or inserted into the recess, groove, or channel. The elongated profile 50 may have a lip, overhang, or protrusion which covers at least a portion of the recess, groove, or channel. This lip may operate to retain the base 12 of the bracket 10 within the recess, groove, or channel.

The base 12 may be installed in the groove with the main body 12*b* aligned with the long axis of the elongated profile 50. A portion of the main body 12*b* may be retained in the recess or groove with the lip. A portion of each of the first extending portion 12*a* and the second extending portion 12*c* may be retained in the recess or groove with the lip.

Figure 8:
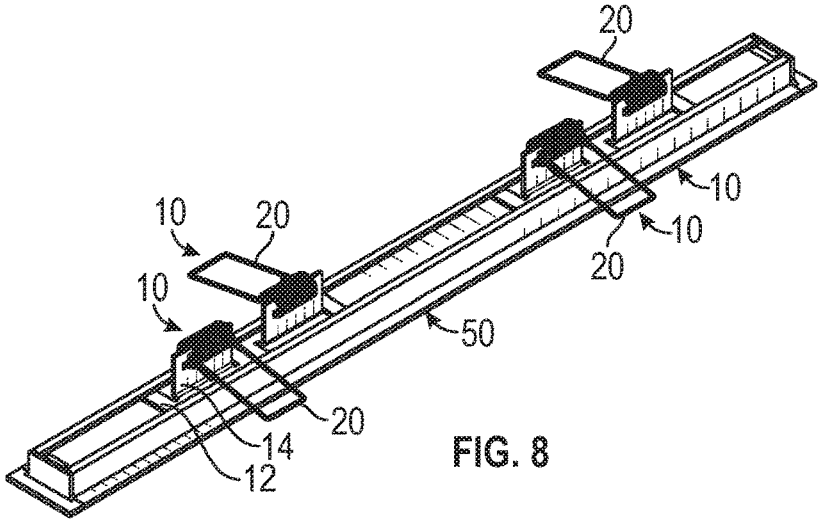
FIG. 8 shows a perspective of an assembly having a mounting bracket according to FIG. 1 installed on an elongated profile, according to an embodiment.
Figure 9:
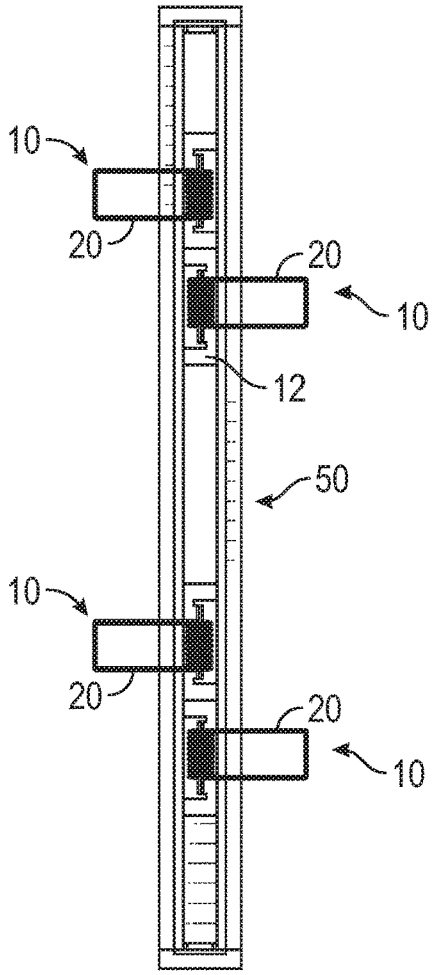
FIG. 9 shows a top view of the assembly of FIG. 8, according to an embodiment.

A plurality of mounting brackets 10 may be installed in the elongated profile 50. The mounting brackets 10 may be inserted into the profile 50 spaced along the axial length of the profile 50 as shown. The mounting brackets 10 may be inserted into the profile 50 in an alternating manner, as best shown in FIGS. 8 and 9. That is, the main body 12*b* and the extending portions 12*a*, 12*c* may be rotated 180 degrees between adjacent mounting brackets. For example, in FIG. 9, the forward most mounting bracket 10 may be inserted with the main body 12*b* along the right side of the elongated profile. The next adjacent mounting bracket 10 may be inserted with main body 12*b* along the left side of the elongated profile. The alternating pattern may proceed for the length of the elongated profile 50.

The elongated portion 20 of each mounting bracket 10 may also be arranged in an alternative manner. For example, in FIG. 9, the forward most mounting bracket 10 may arranged with the elongated portion 20 extending to the right side of the elongated profile 50. The next adjacent mounting bracket 10 may be arranged with the elongated portion 20 extending to the left side of the elongated profile 50. The alternative pattern may proceed for the length of the elongated profile 50.

Alternatively either the main body 12*b* and/or the elongated portion 20 of each mounting bracket 10 may be aligned to the same side of the elongated profile 50 or may alternate in other patterns than shown. For example, the first mounting bracket 10 may have portions extending to the right and the next two adjacent mounting brackets may extend to the left. The pattern may then be repeated. Although FIGS. 8 and 9 are shown with the elongated portion 20 first extending to the right, the alternate position may be taken. Additionally, although 4 mounting brackets 10 are shown coupled to the elongated profile 50, more or fewer may be provided.

In each individual mounting bracket 10, the elongated portion 20 may be arranged to extend from the main body 12*b* in an opposing direction from the first extending portion 12*a* and the second extending portion 12*c*. Alternatively, the elongated portion 20 may extend from the main body 12*b* in substantially the same direction as the first extending portion 12*a* and the second extending portion 12*c*.

Figure 10:
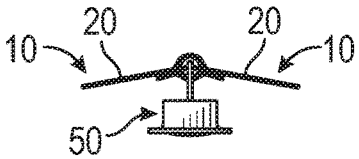
FIG. 10 shows an end view of the assembly of FIG. 8, according to an embodiment.
Figure 11:
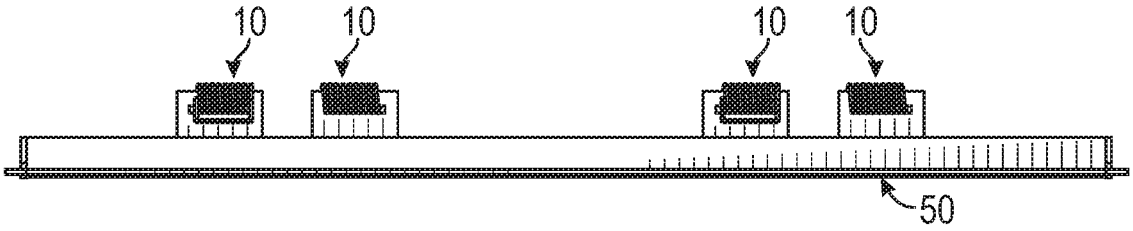
FIG. 11 shows a side view of the assembly of FIG. 8, according to an embodiment.

As further shown in FIGS. 8 and 10, the flange 14 may extend vertically from the elongated profile 50. This may allow for the elongated portion 20 to extend not only laterally, but vertically downward as well. For example, FIG. 10 shows the elongated portion 20 extending to the side of the flange 14 and extending downward slightly with respect to the horizontal axis, such that the elongated portion 20 and the base 12 are not parallel. The elongated portion 20 shown in the position of FIG. 10 may rotated with respect to the position of the elongated portion in FIG. 1. The elongated portion 20 in FIG. 10 may be rotated from about 5 degrees to about 85 degrees with respect to an axis extending vertically with the flange 14.

Figure 12:
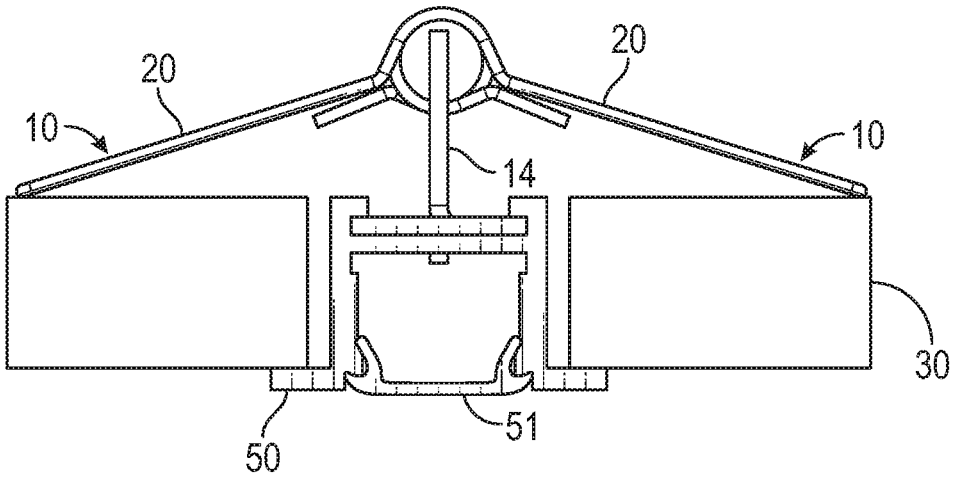
FIG. 12 shows the assembly of FIG. 8 mounted to a surface.

Referring to FIG. 12, the mounting bracket 10 is shown installed with the elongated profile 50 to a surface 30. The surface may be a gypsum surface, a wall board, a wall, a ceiling, or other hard surface. An opening may be provided in the surface 30 such that a body of the elongated profile 50 fits within the opening. The opening may be elongated, to fit or exceed the length of the elongated profile. The opening may be substantially rectangular to accommodate the substantially rectangular body of the elongated profile 50. As shown, the opening may extend all the way through the surface 30 from a front surface to a rear surface. One or more mounting brackets 10 may be installed in the groove of the elongated profile as described with respect to FIGS. 8-11. To couple the elongated profile 50 to the surface 30, the mounting brackets 10 may be arranged with the elongated portions 20 extending vertically, such as in FIG. 1. This may allow for the mounting bracket 10 to extend upward and into the opening. The elongated portions 20 may then be rotated such that second leg 20*b* rests on a rear side of the surface 30. In the installed position of FIG. 12, the elongated portion 20 may extend at about a 45 degree angle with respect to the flange 14.

The elongated profile 50 may house one or more LED lights to provide recessed lighting. A cover or lens 51 may be installed over the LEDs to provide the desired lighting effect and/or prevent access to the LEDs. Although described as housing LED lights, the elongated profile 50 may house any type of lighting or other object desired to be mounted in a linear path to a surface. Thus, the mounting brackets 10 may be provided to mount any elongated profile housing any product in a linear fashion to an external surface.

With reference to FIGS. 1-12, the mounting bracket 10 may have an initial state or uninstalled state. The initial state may also be the state where the mounting bracket 10 is not installed in the elongated profile 50. The initial state may be a state where the spring 16 is free or unbiased. That is, a state where the spring 16 may pivot or rotate about the opening 18 in the flange 14. Such a state is shown in FIGS. 1-7 where the spring 16 hangs freely, without biasing or obstruction from another surface. In this state, the spring 16 may be unloaded, unbiased, and/or uncompressed. The spring 16 may be restricted from rotation only when the spring 16 contacts the base 12.

The mounting bracket 10 may have another state, a partially installed state, such as shown in FIGS. 8-11. The partially installed state may be the state where the mounting bracket 10 is installed in the elongated profile 50 (e.g., the base 12 is within the opening of the elongated profile 50) but also a state where the spring 16 is free to pivot or rotate about the opening 18 in the flange 14. In the partially installed state, the spring 16 may continue to be unbiased. However, as compared to the initial state, the spring 16 may be restricted from rotating by the edges of the elongated profile. In this state, the mounting bracket 10 is partially installed as the mounting bracket 10 is installed in the opening of the elongated profile 50, but the spring 16 does not yet contact the surface 30 to bias the mounting bracket 10 and maintain the elongated profile 50 within the opening in the surface 30, as will be described in more detail.

Referring to FIG. 12, the mounting bracket 10 may have another state, a fully installed state. The fully installed state may be the state where the mounting bracket 10 is installed in the elongated profile 50, such as in the partially installed state, and also a state where the spring 16 is biased between the surface 30 and the flange 14. In this state, the spring 16 may operate to provide a biasing force thus maintaining the bracket 10 and elongated profile 50, within the opening of the surface 30.

The initial state and the partially installed state may be states where the mounting bracket 10 does not provide the elongated profile 50 in an installed and securely mounted position within the surface 30. The fully installed state may be a state where the mounting bracket 10 allows the elongated profile 50 to be installed and securely mounted to the surface 30. The mounting bracket 10 may move between the initial state, the partially installed state, and the fully installed state sequentially or in another order. The mounting bracket 10 may be moved from the fully installed state back to the initial state when the elongated profile 50 is to be unmounted from the surface 30.

Referring to FIGS. 13-19, a mounting bracket 100 is shown. The mounting bracket 100 may include a body 102. The body 102 may have a base 104 with outward extending portions 106, 108, 110, and 112. The outward extending portions 106 and 110 may be mirror images. The outward extending portions 108 and 112 may be mirror images. The mounting bracket 100 may include a flat spring. That is, the outward extending portions 106 and 110 may each be a flat spring with an apex in the middle.

Figure 14:
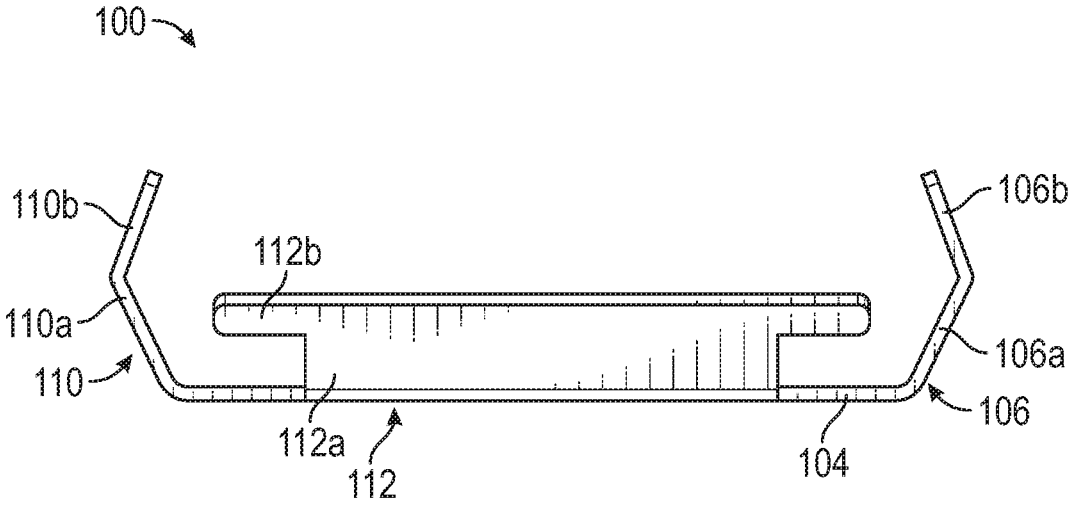
FIG. 14 shows a front view of the mounting bracket of FIG. 13, according to an embodiment.
Figure 15:
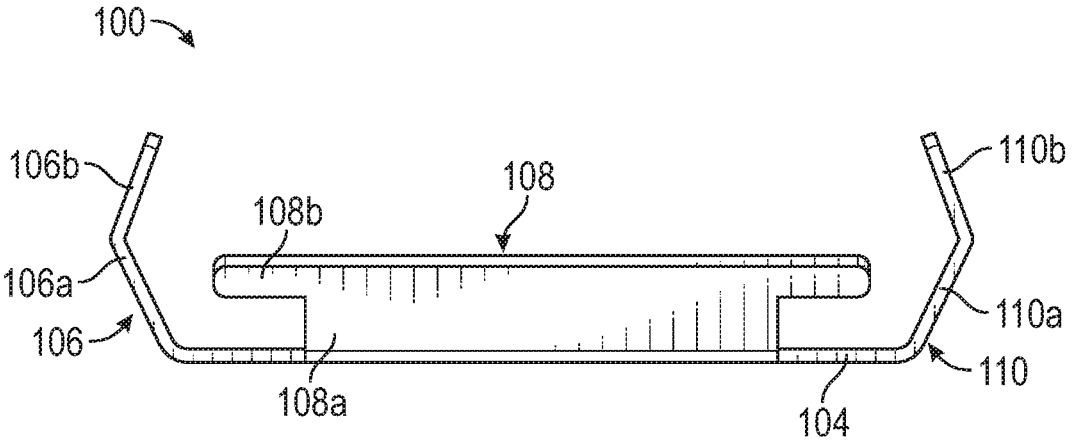
FIG. 15 shows a rear view of the mounting bracket of FIG. 13, according to an embodiment.
Figure 16:
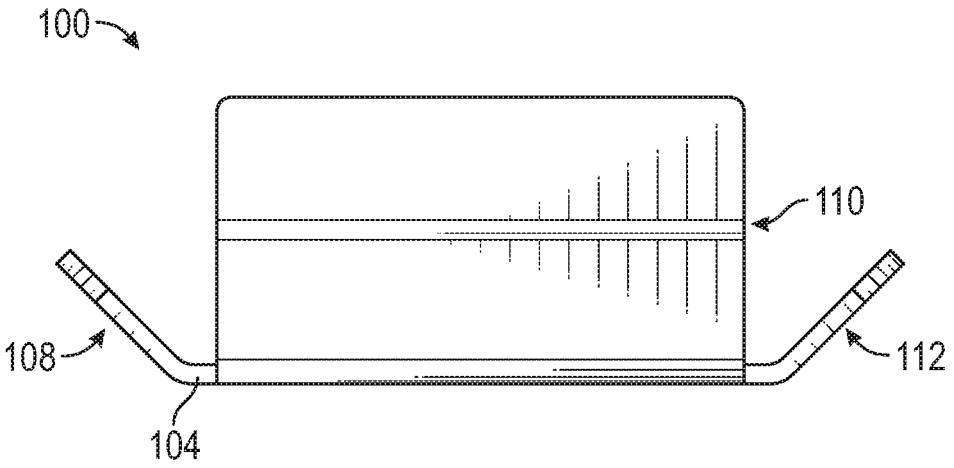
FIG. 16 shows a left view of the mounting bracket of FIG. 13, according to an embodiment.
Figure 17:
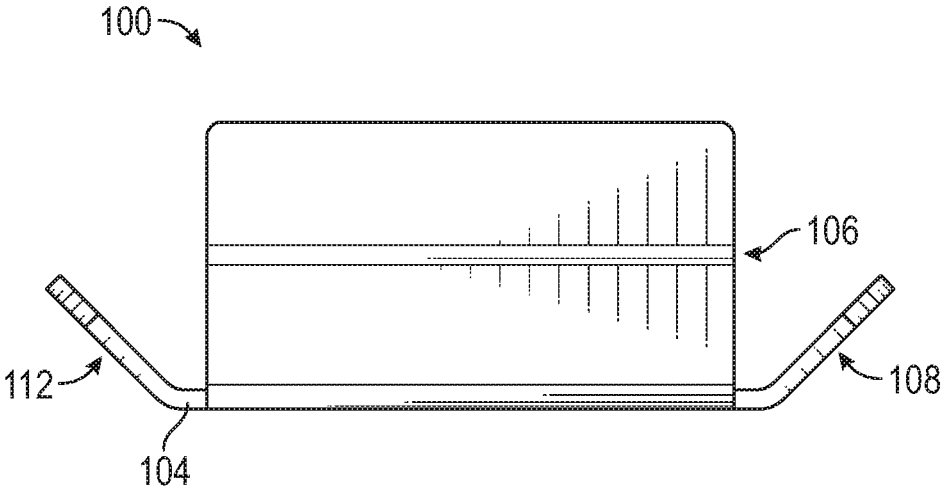
FIG. 17 shows a right view of the mounting bracket of FIG. 13, according to an embodiment.
Figure 18:
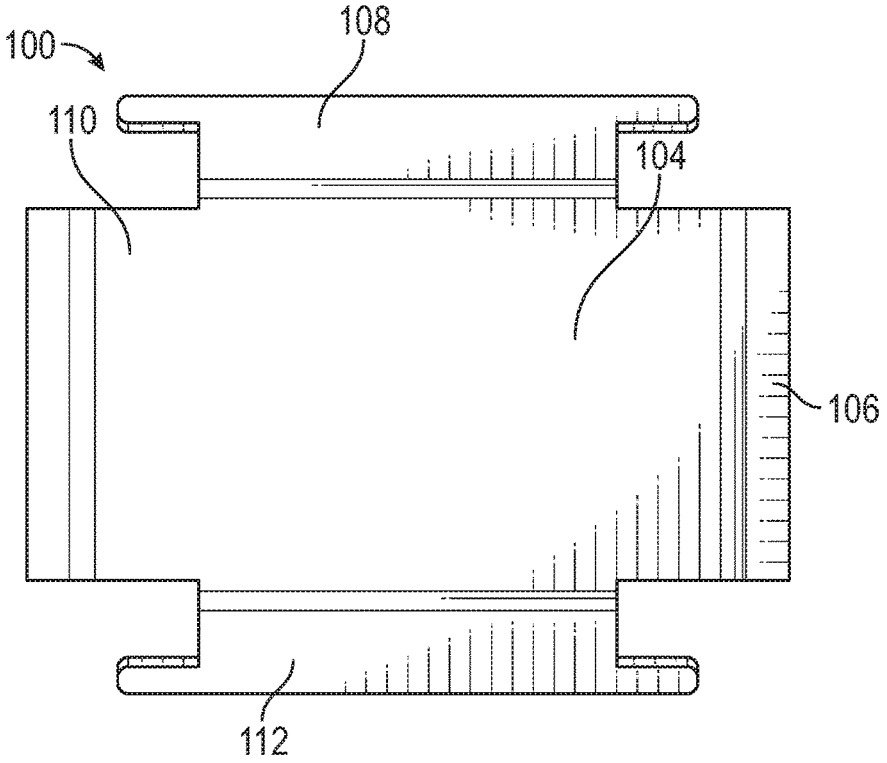
FIG. 18 shows a top view of the mounting bracket of FIG. 13, according to an embodiment.
Figure 19:
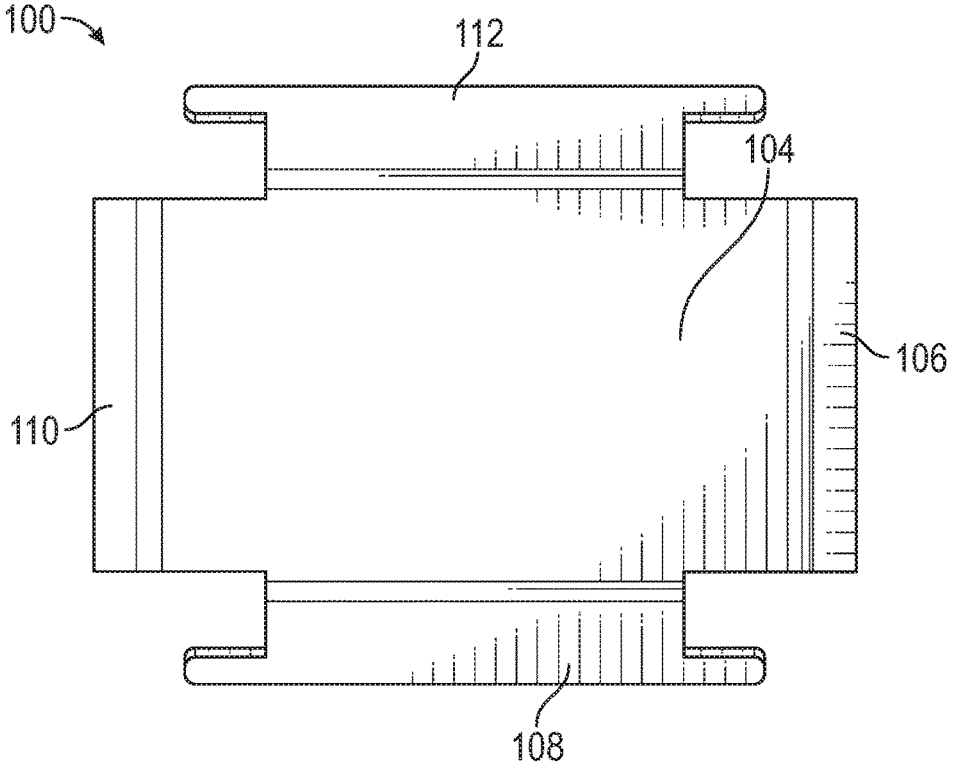
FIG. 19 shows a bottom view of the mounting bracket of FIG. 13, according to an embodiment.
Figure 20:
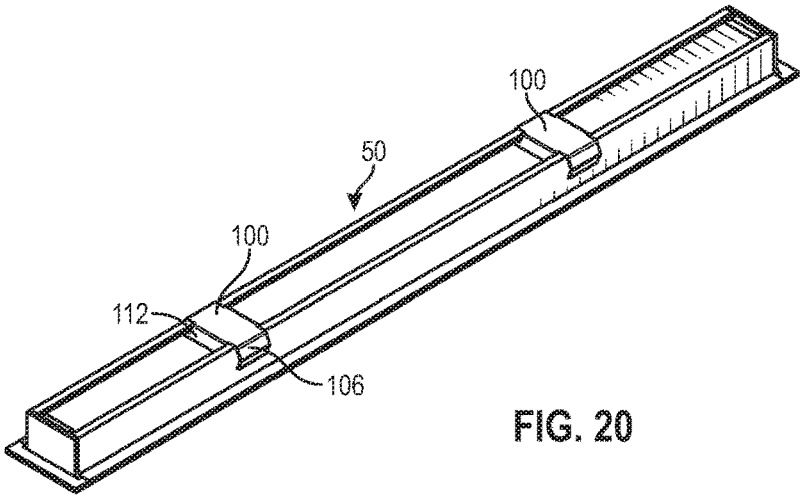
FIG. 20 shows a perspective of an assembly having a mounting bracket according to FIG. 13 installed on an elongated profile, according to an embodiment.
Figure 21:
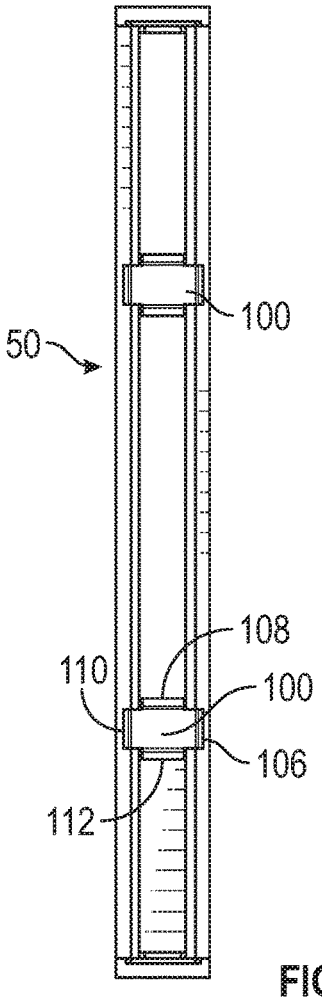
FIG. 21 shows a top view of the assembly of FIG. 20, according to an embodiment.
Figure 22:
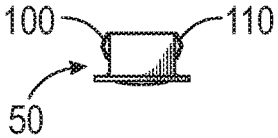
FIG. 22 shows an end view of the assembly of FIG. 20, according to an embodiment.
Figure 23:
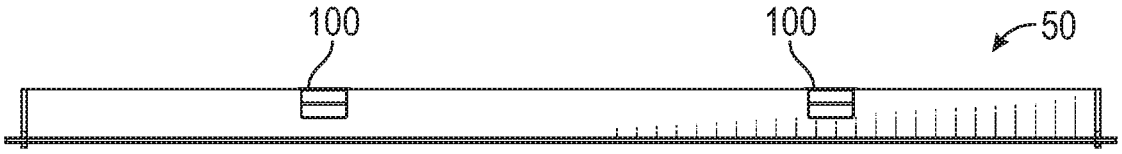
FIG. 23 shows a side view of the assembly of FIG. 20, according to an embodiment.

Referring to FIGS. 14 and 15, the outward extending portion 106 may have a first leg 106*a* and a second leg 106*b*. The first leg 106*a* may be angled with respect to the base 104. The angle may be greater than 90 degrees. The second leg 106*b* may be angled with respect to the first leg 106*a*. The angle may be greater than 90 degrees. The outward extending portion 110 may have a first leg 110*a* and a second leg 110*b*. The first leg 110*a* may be angled with respect to the base 104. The angle may be greater than 90 degrees. The second leg 110*b* may be angled with respect to the first leg 110*a*. The angle may be greater than 90 degrees. Being mirror images, the first legs 106*a*, 110*a* extend outward from each other. The second legs 106*b*, 110*b* extend inward toward each other.

With reference to FIGS. 13-19, the outward extending portion 112 may include a substantially rectangular portion 112*a* and an elongated portion 112*b*. The outward extending portion 112 may be substantially "T" shaped. The outward extending portion 112 may extend outward from the base 104. The outward extending portion 108 may include a substantially rectangular portion 108*a* and an elongated portion 108*b*. The outward extending portion 108 may be substantially "T" shaped. The outward extending portion 108 may extend outward from the base 104. Being mirror images, the outward extending portions 112, 108 may extend outward from each other.

Figure 13:
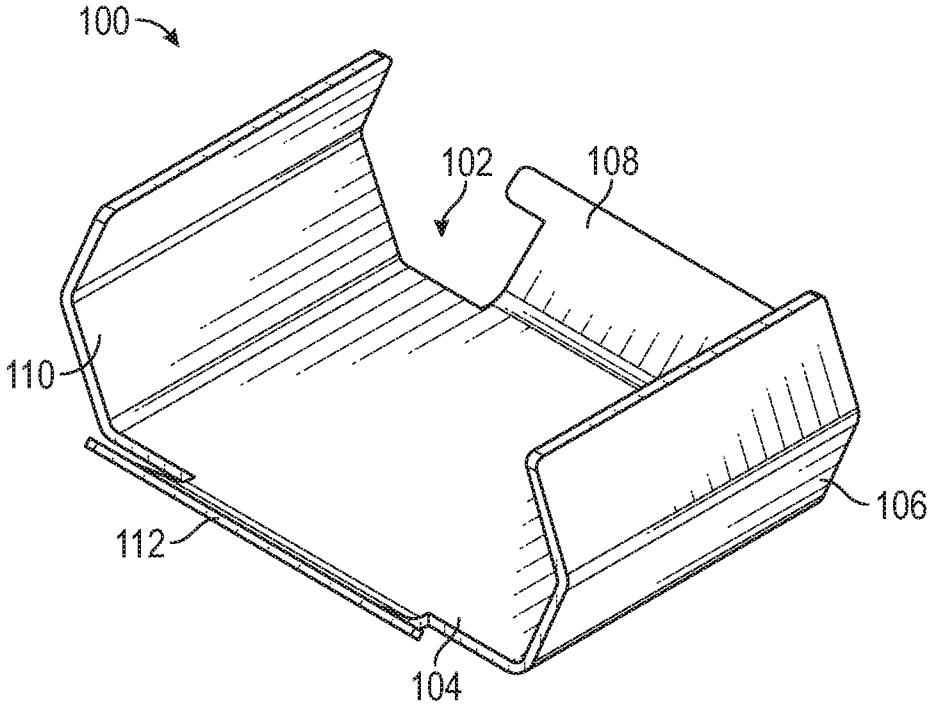
FIG. 13 shows a perspective view of a mounting bracket, according to an embodiment.

As shown in FIG. 13, all of the outward extending portions may extend outward from the base 104 in an opposing direction from the remaining outward extending portions and/or in opposing directions from the outward extending portion on the opposing side of the base 104.

Referring to FIGS. 20-24, the mounting bracket 100 is shown in conjunction with an elongated profile 50. As will be described in more detail, the elongated profile 50 may include a recess or groove in which the mounting bracket 100 may be received. The elongated portion 108*b*, 112*b* may be pushed, slid, aligned, or otherwise installed or inserted into the recess or groove. The elongated profile 50 may have a lip, overhang, or protrusion which covers at least a portion of the recess or groove. This lip may operate to retain the elongated portions 108*b*, 112*b* of the bracket within the recess or groove.

As mentioned, a portion of the elongated portions 108*b*, 112*b* may be retained in the recess or groove with the lip. A portion of each of the outward extending portions 106, 110 may extend over an outer wall of the elongated profile 50. In each individual mounting bracket 100, the base 104 may extend over a top of the elongated profile 50 with the outward extending portions 106, 110 attaching or "hugging" the outside surface of the elongated profile 50.

A plurality of mounting brackets 100 may be installed in the elongated profile 50. The mounting brackets 100 may be inserted into the profile 50 spaced along the axial length of the profile 50 as shown. Although 2 mounting brackets 100 are shown coupled to the elongated profile 50, more or fewer may be provided.

Figure 24:
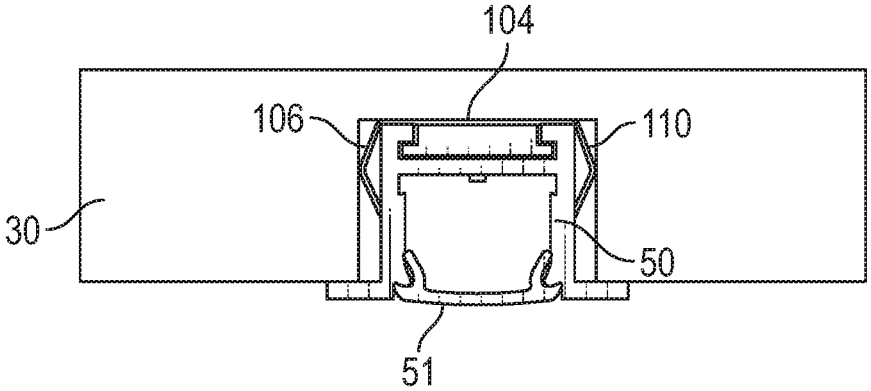
FIG. 24 shows the assembly of FIG. 20 mounted to a surface.

Referring to FIG. 24, the mounting bracket 100 is shown installed with the elongated profile 50 to a surface 30. The surface may be a gypsum surface, a wall board, a wall, a ceiling, or other hard surface. An opening may be provided in the surface 30 such that a body of the elongated profile 50 fits within the opening. The opening may be elongated, to fit or exceed the length of the elongated profile 50. The opening may be substantially rectangular to accommodate the substantially rectangular body of the elongated profile 50. As shown, the opening may not extend all the way through the surface 30 from a front surface to a rear surface. Instead, the opening may extend through the front surface while the rear surface remains intact. The opening may be formed as a notch, slot, or channel with an end surface and two side surfaces. One or more mounting brackets 100 may be installed in the groove of the elongated profile as described with respect to FIGS. 20-24. To couple the elongated profile 50 to the surface 30, the mounting brackets 100 may be arranged with an apex where the first leg 106*a* and second leg 106*b* meet may abut the inner surface of a first side of the opening in the surface 30. Similarly, an apex where the first leg 110*a* and the second leg 110*b* meet may abut the inner surface of a second side of the opening in the surface 30. The outward extending portions 106, 110 may extend in opposing directions and may thus abut opposing walls of the opening in the surface 30. The base 104 may align with, abut, or be adjacent to the end surface of the opening.

The elongated profile 50 may house one or more LED lights to provide recessed lighting. A cover or lens 51 may be installed over the LEDs to provide the desired lighting effect and/or prevent access to the LEDs. Although described as housing LED lights, the elongated profile 50 may house any type of lighting or other object desired to be mounted in a linear path to a surface. Thus, the mounting brackets 100 may be provided to mount any elongated profile housing any product in a linear fashion to an external surface.

With reference to FIGS. 13-24, the mounting bracket 100 may have an initial state or uninstalled state. The initial state may also be the state where the mounting bracket 100 is not installed in the elongated profile 50. The initial state may be a state where the outward extending portions of the mounting bracket 100 may be flexed freely and are in an unbiased, uncompressed position. Such a state is shown in FIGS. 13-19 where the bracket 100 is in a steady state position without biasing or obstruction from another surface. In this state, the flat springs of the mounting bracket 100 may be unloaded, unbiased, and/or uncompressed.

The mounting bracket 100 may have another state, a partially installed state, such as shown in FIGS. 20-23. The partially installed state may be the state where the mounting bracket 100 is installed in the elongated profile 50 but also a state where the flat springs of the mounting bracket 100 are not biased against a surface of the opening in the surface 30. In this state, the mounting bracket 100 is partially installed as the mounting bracket 100 is installed in the opening of the elongated profile 50, but the flat springs do not yet contact the surface 30 to bias the mounting bracket 100 and maintain the elongated profile 50 within the opening in the surface 30, as will be described in more detail.

Referring to FIG. 24, the mounting bracket 100 may have another state, a fully installed state. The fully installed state may be the state where the mounting bracket 100 is installed in the elongated profile 50, such as in the partially installed state, and also a state where the flat springs (e.g., the outward extending portions 106, 110) are biased between the inner walls of the opening in the surface 30 and the elongated profile 50. In this state, the flat springs may operate to provide a biasing force thus maintaining the bracket 100 and elongated profile 50, within the opening of the surface 30.

The initial state and the partially installed state may be states where the mounting bracket 100 does not provide the elongated profile 50 in an installed and securely mounted position within the surface 30. The fully installed state may be a state where the mounting bracket 100 allows the elongated profile 50 to be installed and securely mounted to the surface 30. The mounting bracket 100 may move between the initial state, the partially installed state, and the fully installed state sequentially or in another order. The mounting bracket 100 may be moved from the fully installed state back to the initial state when the elongated profile 50 is to be unmounted from the surface 30.

Figure 25:
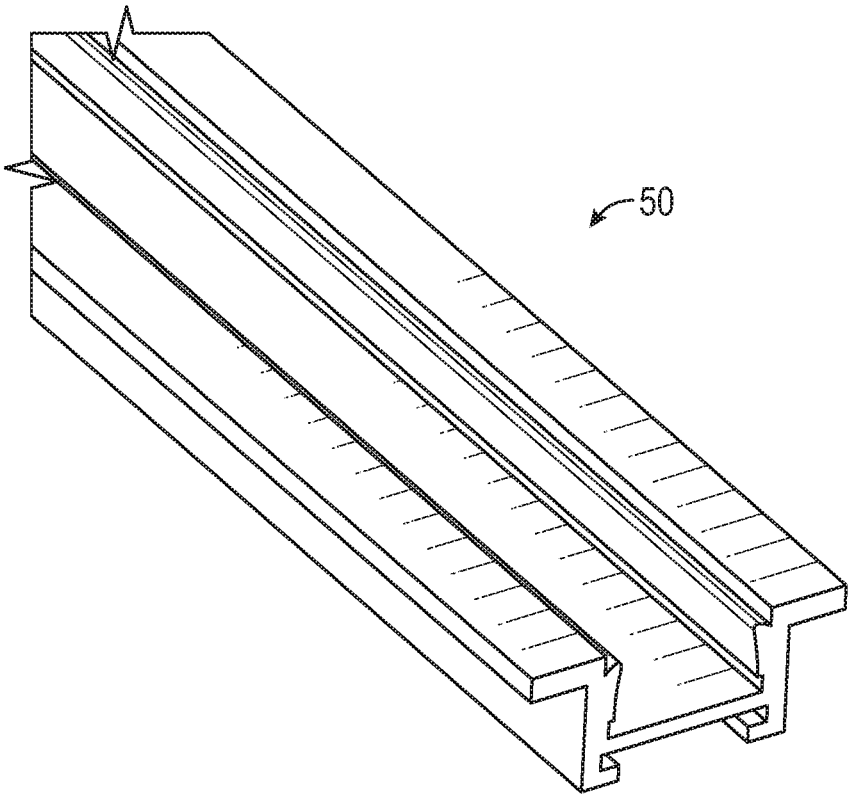
FIG. 25 shows a partial perspective view of an elongated profile, according to an embodiment.
Figure 26:
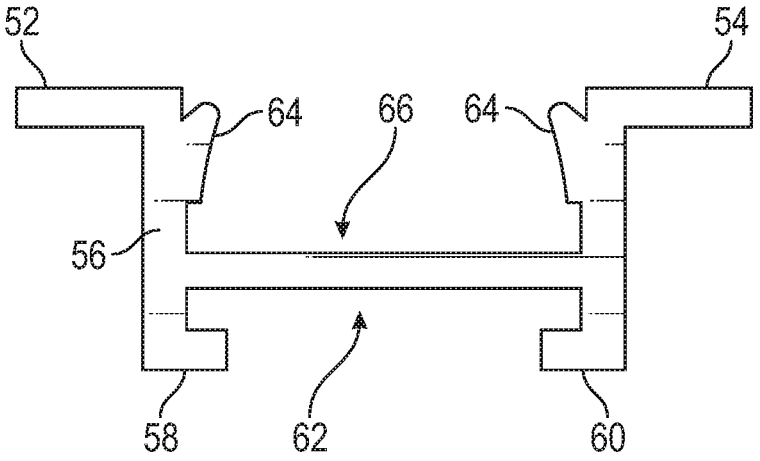
FIG. 26 shows an end view of the elongated profile of FIG. 25, according to an embodiment.

Referring to FIGS. 25 and 26, an elongated profile 50 is shown. The elongated profile 50 may be used with the mounting bracket 10 and/or the mounting bracket 100. The elongated profile 50 may be an extruded profile. The elongated profile 50 may have a main body 56. The main body may have a first channel 62 and a second channel 66. The first channel 62 and the second channel 66 may extend along the length of the main body 56 along the length of the elongated profile 50. The first channel 62 and/or the second channel 66 may be a recess, groove, or channel in the main body 56.

Referring to FIG. 26, the first channel 62 may include a first lip 58 and a second lip 60. The first lip 58 and/or the second lip 60 may be a lip, overhang, or protrusion which covers at least a portion of the first channel 62. Referring back to FIGS. 8, 9, and 12 and FIGS. 20, 21, and 24, the first lip 58 and the second lip 60 may retain a portion(s) of the mounting brackets 10, 100 within the first channel 62. For example, referring to FIGS. 8, 9, and 12, the first extending portion 12*a* and the second extending portion 12*c* of the base 12 may be retained in the first channel 62. The base 12 may be slid, aligned, or otherwise installed or inserted into the first channel 62. The first lip 58 and the second lip 60 may operate to retain the base 12 of the bracket 10 within the first channel 62. For further example, referring to FIGS. 20, 21, and 24, the outward extending portions 108, 112 may be retained in the first channel 62. The outward extending portions 108, 112 may be slid, aligned, pressed, or otherwise installed or inserted into the first channel 62. The first lip 58 and the second lip 60 may operate to retain the elongated portion 108*b*, 112*b* of the outward extending portions 108, 112, respectively, of the bracket 100 within the first channel 62.

With continued reference to FIG. 26, the second channel 66 may include one or more protrusions 64. The protrusions 64 may retain the cover or lens 51 (FIGS. 12 and 24) within the second channel 66. The LEDs may extend within the second channel 66. The cover or lens 51 may operate to retain and/or to prevent access to the LEDs.

Figure 27:
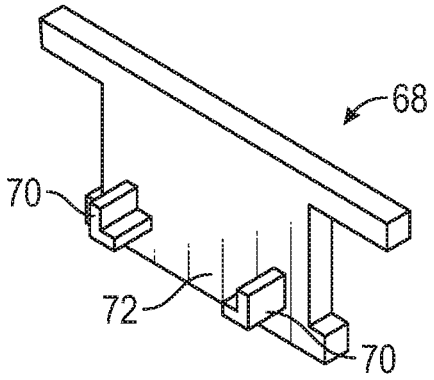
FIG. 27 shows a perspective view of an end cap for an elongated profile, according to an embodiment.
Figure 28:
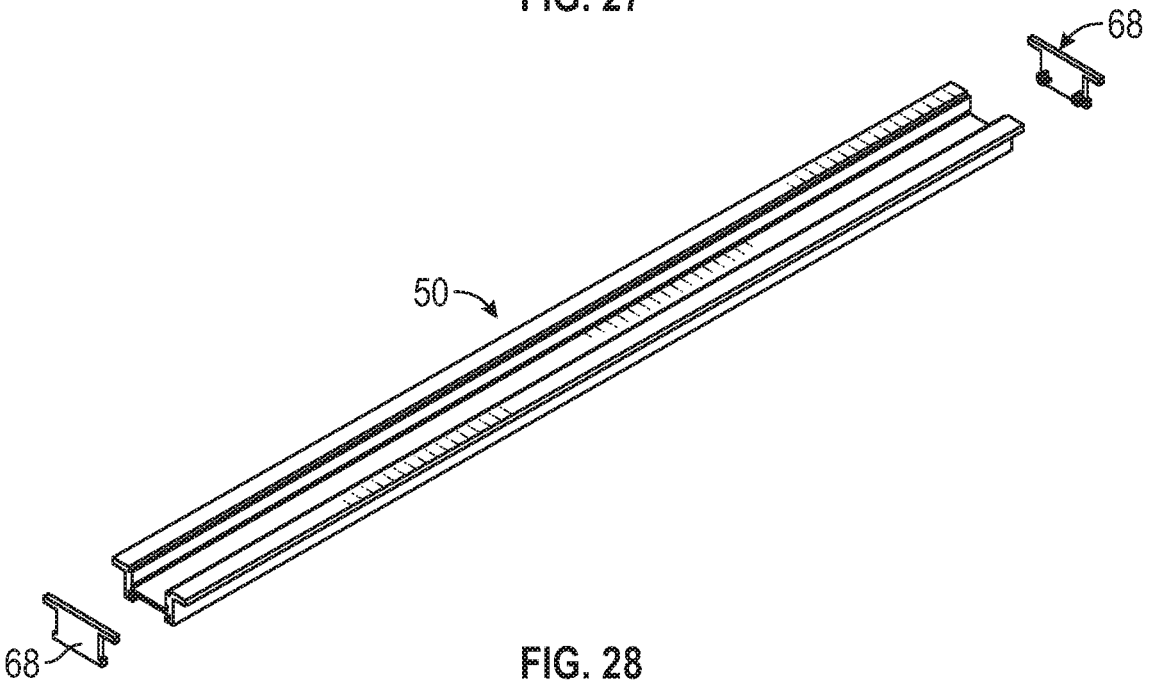
FIG. 28 shows an exploded view of an elongated profile and end cap, according to an embodiment.

The elongated profile 50 may include a first flange 52 and a second flange 54. The first flange 52 and the second flange 54 may abut the surface 30 when the elongated profile 50 is installed, see, for example, FIGS. 12 and 24. The elongated profile 50 may be provided with one or more end caps 68 as shown in FIGS. 27 and 28. The end cap 68 may include a body 72 with protrusions 70. The protrusions 70 may fit within the first channel 62 and may be retained therein.

The mounting bracket may be selected based on which opening is formed in the surface 30. In the case of the type of opening formed in FIG. 12, the mounting bracket 10 may be selected. In the case of the type of opening formed in FIG. 24, the mounting bracket 100 may be selected. The elongated profile 50 may be installed on the surface 30 with the mounting bracket 10 and/or the mounting bracket 100.

Accordingly, to install the elongated profile 50 on a surface 30, such as when installing recessed lighting, with the mounting bracket 10 of FIGS. 1-12, the following steps may be performed. An opening may be formed in the surface 30. The opening may extend all the way through the surface 30 from a front surface to rear surface, such as shown in FIG. 12.

The number of mounting brackets 10 installed may depend on the type of mounting bracket, the length of the elongated profile 50, the surface 30 to which the elongated profile 50 is to be mounted, the weight of the assembled elongated profile 50 (with the LEDs), etc. Once the desired number of mounting brackets 10 are identified, they may be installed onto the elongated profile 50. The base 12 may be installed in the first channel 62 of the elongated profile 50. After the desired number of mounting brackets 10 are installed, the end caps 68 may be installed on opposing ends of the elongated profile 50. This may prevent the mounting brackets 10 from disengaging form the first channel 62. As previously described, the mounting brackets 10 may be installed on the elongated profile 50 in an alternating manner, that is, with the first extending portion 12*a* and the second extending portion 12*c* facing in opposing directions with respect to adjacent mounting brackets 10. Alternatively, the mounting brackets 10 may be aligned in the same orientation.

Prior to, or after, installation of the mounting brackets 10 and/or end caps 68, the LEDs to be housed in second channel 66 may be installed. The lens 51 may also be installed. The end caps 68 may be installed last to ensure the mounting brackets 10, the LEDs, and/or the lens 51 may be retained within the elongated profile 50.

The elongated profile 50 and mounting brackets 10 may be fitted within the opening in the surface 30. The mounting brackets 10 may be installed such that the elongated portion 20 of each bracket is located behind the surface 30. This may allow the mounting brackets 10 to anchor or mount the elongated profile 50 to the surface 30. Once the elongated profile 50 is installed in the opening, the elongated portions 20 of the mounting brackets 10 may be pivoted or rotated such that the second leg 20*b* abuts the interior of the rear surface of the surface 30. In this position, the springs 16 of each mounting bracket 10 may apply a biasing force to the surface 30, thus maintaining and securing the elongated profile 50 to the surface 30. As previously mentioned, the elongated portions 20 may be rotated or pivoted in opposing manners such that elongated portions 20 of adjacent mounting brackets 10 are placed in opposing directions. The mounting brackets 10 may then retainer or hold the elongated profile 50 within the surface 30.

To install the elongated profile 50 on a surface 30, such as when installing recessed lighting, with the mounting bracket 100 of FIGS. 13-24, the following steps may be performed. An opening may be formed in the surface 30. The opening may not extend all the way from a front surface to rear surface, but instead may have an end wall and two sides, such as shown in FIG. 24.

The number of mounting brackets 100 installed may depend on the type of mounting bracket, the length of the elongated profile 50, the surface 30 to which the elongated profile 50 is to be mounted, the weight of the assembled elongated profile 50 (with the LEDs), etc. Once the desired number of mounting brackets 100 are identified, they may be installed onto the elongated profile 50. The mounting brackets may be press fit over the outer surface of the main body 56 such that the outward extending portions 106, 110 extend over the sides of the main body 56 and such that the outward extending portions 108, 112 are received within the first channel 62. The elongated portions 108*b*, 112*b* may be engaged under the lips 58, 60 of the channel to secure the mounting brackets 100 to the elongated profile 50. Alternatively, the mounting brackets 100 may be slid or otherwise engaged in the first channel 62. The end caps 68 may be installed on opposing ends of the elongated profile 50. This may prevent the mounting brackets 100 from disengaging form the first channel 62.

Prior to, or after, installation of the mounting brackets 100 and/or end caps 68, the LEDs to be housed in second channel 66 may be installed. The lens 51 may also be installed. The end caps 68 may be installed last to ensure the mounting brackets 100, the LEDs, and/or the lens 51 may be retained within the elongated profile 50.

The elongated profile 50 and mounting brackets 100 may be fitted within the opening in the surface 30. The mounting brackets 100 may be installed such that an apex of each outward extending portion 106, 110 engages the side surfaces of the opening in the surface 30. The elongated profile 50 may then be press fit or force fit into the opening and the apex (the point where 106*a* and 106*b* meet and where 110*a* and 110*b* meet) may engaged with the side surfaces providing a biasing force to the walls of the opening in the surface 30 and thus retaining the elongated profile 50 in the surface 30. The mounting brackets 100 may then retain or hold the elongated profile 50 in the surface 30.

Referring back to FIG. 26, an overall width of the main body 56 of the elongated profile 50 at the end with the first channel 62 may be about 0.69 inches. An overall width of the main body 56 of the elongated profile 50 from an outer end of the first flange 52 to an outer end of the second flange 54 may be about 1.00 inches. An overall height of the elongated profile may be about 0.42 inches. An overall height of the elongated profile 50 below the flanges 52, 54 may be about 0.36 inches. The length of the elongated profile 50 may be any length up to about 144 inches, for example, may be about 48 inches, about 96 inches, or about 144 inches. The elongated profile 50 may be a linear aluminum extrusion that is designed to fit many recess-mounted LED lighting needs. The elongated profile 50 may be a discrete profile and may have a neutral finish to allow for the perfect fit in multiple mounting surfaces for any application. The end caps 68 may match the elongated profile 50. The elongated profile 50 and/or the end cap 68 may have a silver anodized or white finish.

The lens 51 may be a diffuser lens. The lens 51 may be polycarbonate, may snap in place, and may be UV resistance. The overall height of the elongated profile 50 with the lens 51 installed may be about 0.44 inches. The lens 51 may be clear, frosted, partially frosted, or half frosted.

Referring back to FIGS. 1-12, the mounting bracket 10 may be galvanized steel. The mounting bracket 10 may be for mounting in gypsum, such as drywall, plaster, etc. Referring back to FIGS. 13-24, the mounting bracket 100 may be stainless steel. The mounting bracket 100 may be for mounting in hard surfaces, such as wood, stone, tile, etc.

Although the foregoing description is directed to the preferred embodiments of the invention, it is noted that other variations and modifications will be apparent to those skilled in the art, and may be made without departing from the spirit or scope of the invention. Moreover, features described in connection with one embodiment of the invention may be used in conjunction with other embodiments, even if not explicitly stated above.

The invention claimed is:

1. A system for mounting recessed lighting, the system comprising:

an elongated profile, the elongated profile having:

a first channel extending along a length of the elongated profile; and a second channel opposing the first channel and extending along the length of the elongated profile; and mounting brackets disposed in the first channel, the mounting brackets each comprising (i) a base with at least a first portion that is retained within the first channel, and (ii) a spring configured to secure the elongated profile to a surface, wherein the mounting brackets are disposed along the length of the elongated profile.

2. The system of claim 1, wherein the system is for mounting recessed LED lighting.

3. The system of claim 1, wherein the spring is one of a coil spring or a flat spring.

4. The system of claim 1, wherein the elongated profile is configured to be installed in an opening in the surface.

5. The system of claim 4, wherein the opening is a through-hole extending from a front to a rear of the surface and wherein each of the mounting brackets further comprises a flange coupled to the base, with the spring being pivotally coupled to the flange.

6. The system of claim 5, wherein the spring comprises a coil portion and an elongated portion and wherein the elongated portion is configured to engage the rear of the surface.

7. The system of claim 6, wherein the spring is entirely located behind the rear of the surface.

8. The system of claim 6, wherein the elongated portion of adjacent mounting brackets extend in opposing directions.

9. The system of claim 4, wherein the opening is a notch or slot extending within the surface and wherein each of the mounting brackets further comprises a plurality of outward extending portions coupled to the base.

10. The system of claim 9, wherein two opposing outward extending portions of the plurality of outward extending portions are flat springs, and wherein an apex of the flat springs are configured to engage opposing side walls of the opening.

11. The system of claim 10, wherein the flat springs are entirely located within the opening.

12. A system for mounting recessed lighting, the system comprising:

an elongated profile, the elongated profile having:

a first channel extending along a length of the elongated profile; and a second channel opposing the first channel and extending along the length of the elongated profile; and mounting brackets disposed in the first channel, wherein the mounting brackets are configured to secure the elongated profile to a surface, wherein the mounting brackets include springs, the springs configured to apply force to a portion of the surface to secure the elongated profile to the surface, each of the springs being one of a coil spring or a flat spring, and wherein the mounting brackets are disposed along the length of the elongated profile.

13. A system for mounting recessed lighting, the system comprising:

an elongated profile, the elongated profile having:

a first channel extending along a length of the elongated profile; and a second channel opposing the first channel and extending along the length of the elongated profile; and mounting brackets disposed in the first channel, with each of the mounting brackets comprising a base and a plurality of outward extending portions coupled to the base, wherein the mounting brackets are configured to secure the elongated profile to a surface, wherein the mounting brackets are disposed along the length of the elongated profile, and wherein the elongated profile is configured to be installed in an opening in the surface, the opening being a notch or slot extending within the surface.

* * * * *